US005816915A

United States Patent [19]

Kadlic

[11] Patent Number: 5,816,915

[45] Date of Patent: Oct. 6, 1998

[54] PICK ONE POKER METHOD OF PLAY

[76] Inventor: Thomas P. Kadlic, 4505 W. Hacienda Ave., Suite #G, Las Vegas, Nev. 89118

[21] Appl. No.: 850,625

[22] Filed: May 2, 1997

Related U.S. Application Data

[60] Provisional application No. 60/024,446 Aug. 27, 1996.

[51] Int. Cl.[6] ..... A63F 1/00; A63F 9/22

[52] U.S. Cl. ..... 463/13; 273/292

[58] Field of Search ..... 273/292, 309, 273/274; 463/13

[56] References Cited

U.S. PATENT DOCUMENTS

| | | | |
|---|---|---|---|
| 5,356,140 | 10/1994 | Dabrowski et al. | 273/292 |
| 5,486,005 | 1/1996 | Neal | 273/292 |
| 5,573,249 | 11/1996 | Johnson | 273/292 |
| 5,664,781 | 9/1997 | Feola | 273/292 |

*Primary Examiner*—Benjamin H. Layno
*Attorney, Agent, or Firm*—John Edward Roethel

[57] ABSTRACT

An electronic video draw poker machine is provided with a multi-hand screen display that can show a plurality of five card draw poker hands at the same time. In the preferred embodiment, four separate hands are displayed. A separate five card poker is displayed on a quadrant of the screen display with each five card hand being dealt from its associated deck of playing cards. The initial deal of each five card hand is two cards face up and three cards face down. After the player has selected which five card hand he wishes to play, the game continues in the conventional manner with the player discarding and drawing replacement cards. After the draw step is completed, the final five card hand is compared to a pay table based on poker hand ranking to determine if the player has achieved a winning combination. The amount of the payout to the player for a winning combination is based on the number of coins, tokens or credits wagered by the player and the type of winning hand achieved. Alternatively, all of the initial hands can be dealt from a single deck of playing cards. After the player selects which of the initial hands the player wishes to play, all of the cards from the non-selected hands are returned to the deck to be available as possible replacement cards during the draw step.

25 Claims, 2 Drawing Sheets

| | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR ACES | 80 | 160 | 240 | 320 | 400 |
| FOUR 2's, 3's or 4's | 40 | 80 | 120 | 160 | 200 |
| FOUR 5's THRU KINGS | 20 | 40 | 60 | 80 | 100 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| THREE-OF-A-KIND | 2 | 4 | 6 | 8 | 10 |
| TWO PAIR | 1 | 2 | 3 | 4 | 5 |
| JACKS OR BETTER | 1 | 2 | 3 | 4 | 5 |

| POKER HAND | NUMBER OF COINS BET | | | | |
|---|---|---|---|---|---|
| | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR ACES | 80 | 160 | 240 | 320 | 400 |
| FOUR 2's, 3's or 4's | 40 | 80 | 120 | 160 | 200 |
| FOUR 5's THRU KINGS | 20 | 40 | 60 | 80 | 100 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| THREE-OF-A-KIND | 2 | 4 | 6 | 8 | 10 |
| TWO PAIR | 1 | 2 | 3 | 4 | 5 |
| JACKS OR BETTER | 1 | 2 | 3 | 4 | 5 |

| | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR ACES | 80 | 160 | 240 | 320 | 400 |
| FOUR 2's, 3's or 4's | 40 | 80 | 120 | 160 | 200 |
| FOUR 5's THRU KINGS | 20 | 40 | 60 | 80 | 100 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| THREE-OF-A-KIND | 2 | 4 | 6 | 8 | 10 |
| TWO PAIR | 1 | 2 | 3 | 4 | 5 |
| JACKS OR BETTER | 1 | 2 | 3 | 4 | 5 |

TOUCH SCREEN TO PICK ONE HAND,
PLAY STANDARD VIDEO POKER WITH THAT HAND

PICK ONE POKER METHOD OF PLAY

CROSS-REFERENCE TO RELATED APPLICATION

This application is a Continuation-in-Part of Provisional Application Ser. No. 60/024,446, entitled "Pick One Poker", filed Aug. 27, 1996, now pending.

FIELD OF THE INVENTION

This invention relates to a single player poker game, and more particularly to a single player poker game that can be played as an electronic video poker game or as a live table game and in which the player has the option to select one of four separate, initial hands. The four separate, initial hands can be dealt from a single deck of cards or from four separate decks of cards. The method of the present invention can be played as a casino wagering game or, alternatively, the method of the present invention can also be displayed on a non-wagering amusement device.

BACKGROUND OF THE INVENTION

There have been many types of electronic video gaming machines that have been developed. The electronic video poker gaming machine is designed to replicate the play of a hand of poker. Typically, the player is not playing against any other player's hands or against a dealer's hand; the player is simply attempting to achieve the highest ranking poker hand possible from the cards displayed to the player. The higher the ranking of the poker hand achieved by the player, the greater the player's winnings based on the number of coins, tokens or credits wagered by the player. Typically, a payout schedule is posted on the gaming machine to advise the player of the payoffs available for certain winning card combinations.

The forerunner of all electronic video poker gaming machines is the video Draw Poker machine that deals cards from a standard 52 card poker deck and displays a single five card hand to the player. The player then selects which of the five cards he wishes to hold (or discard depending on the format of the gaming machine). The draw poker machine then displays replacement cards for the cards the player has discarded. The player wins or loses based on conventional poker hand rankings for the resulting five card hand. In video Draw Poker, the conventional poker hand rankings that are winning combinations are a Royal Flush, a Straight Flush, a Four of a Kind, a Full House, a Flush, a Straight, a Three of a Kind, a Two Pair and a Jacks of Better. A payout table is established based on the number of coins wagered by the player and the type of poker hand achieved.

The classic draw poker machine has been modified to use jokers as wild cards or to use deuces (or even other cards) as wild cards. "Joker's Wild" and "Deuces Wild" draw poker still display to the player a single five card hand and allow the player to discard unwanted cards and receive replacement cards. The payout table is modified to recognize the differing odds for achieving various poker hands when wild cards are involved. Furthermore, different poker hand rankings are used in the pay table to recognize different winning combinations that can be achieved using wild cards.

U.S. Pat. No. 5,356,140 (the disclosure of which is incorporated herein by this reference) discloses a method of play of a game generally referred to as "Double Poker". In this method of play, a player makes a wager to participate in the game and the player is dealt two distinct hands at the beginning of the game. Each hand is dealt from its own separate complete deck of cards and all five cards in each hand are dealt face up. The player selects one of the hands to play and the unselected hand is voided or removed from use. The player plays out the selected hand according to the conventional manner of play of traditional video poker games by discarding and receiving replacement cards. All replacement cards are dealt from the particular initial deck of cards from which the first five cards were dealt. The player wins or loses based on a payout schedule applied to preselected winning hand combinations and based on the number of coins wagered by the player.

The method of play disclosed in this patent has the drawback that the player only has two initial five cards hands to choose from and all five cards of each hand are displayed to the player.

It is an object of the present invention to provide a new form of video poker game that gives the player many options as to which hand the player wishes to play during that particular round of the game.

It is a feature of the present invention to provide a multi-hand screen display which initially displays to the player a plurality of separate five card hands. Each of the plurality of five card hands can be dealt from separate deck of cards. Each hand is displayed with two cards face up and three cards face down. The player selects one of the hands to play and the game continues in the conventional manner with the player discarding unwanted cards and receiving replacement cards. The resulting final five card hand is compared to a payout schedule to determine if the player has achieved a winning hand combination.

It is an alternative feature of the present invention to provide a multi-hand screen display which initially displays to the player a plurality of separate five card hands; all of the hands being dealt from the same single deck of cards. Each hand is displayed with two cards face up and three cards face down. The player selects one of the hands to play and all of the cards from the other non-selected hands are returned to the deck and reshuffled to be used as possible replacement cards during the draw. The game continues in the conventional manner with the player discarding unwanted cards and receiving replacement cards. The resulting final five card hand is compared to a payout schedule to determine if the player has achieved a winning hand combination.

It is still a further feature of the present invention to provide special bonus payouts based on the cards revealed during the initial deal of the game. For example, if the initial cards that are face up comprise eight, seven or six Aces or eight, seven, six or five card Royal Flushes, the player can be paid a large jackpot payout.

It is an advantage of the present invention that the player is given multiple options at the beginning of the game to select what the player perceives is the best possible and potential hand.

Other objects, features and advantages of the present invention will become apparent from a consideration of the following detailed description.

SUMMARY OF THE INVENTION

An electronic video draw poker machine is provided with a multi-hand screen display that can show a plurality of five card draw poker hands at the same time. In the preferred embodiment, four separate hands are displayed. A separate five card poker hand is displayed on a quadrant of the screen display with each five card hand being dealt from its associated, separate deck of playing cards. In the preferred embodiment of the present invention, the initial deal of each five card hand is two cards face up and three cards face down. The player selects one of the five card hands to continue play. After the player has selected which five card hand he wishes to play, the game continues in the conventional manner with the player discarding and drawing replacement cards in an attempt to improve his hand. After the draw step is completed, the final five card hand is compared to a pay table based on poker hand ranking to determine if the player has achieved a winning combination. The amount of the payout to the player for a winning combination is based on the number of coins, tokens or credits wagered by the player and the type of winning hand achieved.

Alternatively, instead of using separate decks of playing cards for each hand, all of the initial hands can be dealt from a single deck of playing cards. After the player selects which of the initial hands the player wishes to play, all of the cards from the non-selected hands are returned to the deck to be available as possible replacement cards during the draw step.

DETAILED DESCRIPTION OF THE PREFERRED EMBODIMENTS

Figure 1:
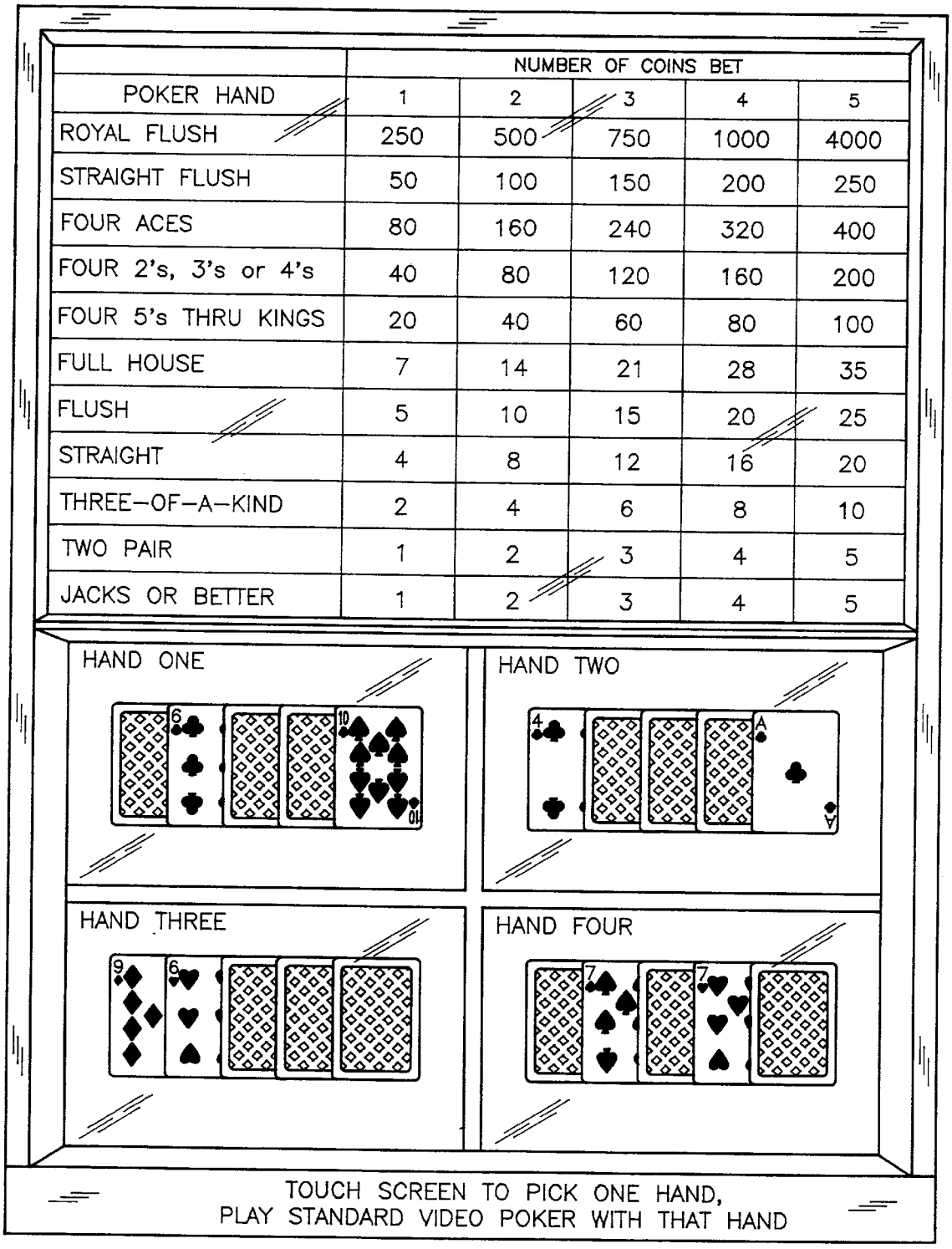
FIG. 1 shows a typical screen display and payout table used in the method of the present invention.

FIG. 1 shows the screen display for an electronic video poker machine programmed to operate in accordance with the method of play in the present invention.

As is conventional in gaming machines of this type, a player wagers one or more coins, tokens, paper currency or credits to activate the game. A coin acceptor or a currency acceptor is provided as is conventional to allow the player to insert coins, tokens or currency to activate the game. In addition to using coin/token acceptor mechanisms or currency acceptor mechanisms or both, the method of the present invention is intended to also include credit coupons, credit or debit card systems, magnetically or optically read memory storage cards or any other apparatus or system by which monetary value can be input by the player and eventually displayed on the credit display on the gaming machine.

Also as is conventional, the screen display can include a credit meter which accrues credits available to the player to play the game and which accrues credits won by the player during the play of the game. When the player wins an award or otherwise decides to stop playing the game, the player is paid his accrued winnings either by means of a coin hopper that dispenses coins or tokens to the player or any of the other myriad devices and apparatus that are available to pay a winning player. The amusement version of the method of play would not require a wager to be made in order to play the game.

In this embodiment of the present invention, the screen display is divided into four quadrants in which the four initially dealt hands, designated as HAND ONE, HAND TWO, HAND THREE and HAND FOUR, respectively, are displayed. Four standard decks of playing cards are used; each of the four hands being associated with one of the four decks. After each of the four separate decks are electronically shuffled, an initial five card hand is dealt from each separate deck of playing cards and displayed in each of the quadrants of the screen display. For example, HAND ONE is dealt from Deck #1, HAND TWO is dealt from Deck #2, HAND THREE is dealt from Deck #3 and HAND FOUR is dealt from Deck #4.

As shown in FIG. 1, each five card hand has two cards dealt face up and the other three cards dealt face down. Which of the particular cards are face up or face down is not critical, as long as in this preferred embodiment each hand has two cards face up and three cards face down. Other embodiments of the present invention can utilize a different number of face up cards and face down cards: such as three cards face up—two cards face down; or four cards face up and one card face down; or one card face up and four cards face down. However, the most preferred embodiment of the present invention is as shown in FIG. 1 in which each hand has two cards face up and three cards face down.

After the initial deal of these four separate hands, the player selects which one of the four hands the player wishes to play for that round of play. This selection can be accomplished by pressing an appropriate button provided on a conventional button panel on the cabinet of the gaming machine or by simply pressing the screen at the location of the desired hand, using conventional touch screen technology that is widely available in gaming devices of this type.

After the player has selected one of the hands to play, the three face down cards in the selected hand are turned face up and displayed to the player. In the preferred embodiment of the present invention, the other three non-selected hands will be removed from the screen display and the selected hand will be re-displayed in the center of the screen using larger card displays to make it easier for the player to see the cards. However, it is also within the scope of the present invention to simply leave the non-selected hands on the screen display as inactive hands.

The player then selects which, if any, of the five cards he wishes to discard. Again this can be accomplished by pressing the appropriate "Hold" buttons as are conventional in electronic video poker gaming machines or by simply pressing the screen at the location of the cards which the player desires to hold using conventional touch screen technology. (The gaming machine can also be configured to provide "Discard" buttons instead of "Hold" buttons whereby the player presses the "Discard" buttons corresponding to the cards the player wishes to discard or the touch screen can be configured so that the cards that the player touches are discarded instead of held. However, the convention currently in use in the electronic video poker gaming machine industry is to have the player select which cards he wishes to hold, not which cards he wishes to discard).

The player activates the "Draw" button to receive replacement cards for the discarded cards, as is conventional in electronic video poker. In this embodiment of the present invention, the replacement cards are dealt using the same fifty-two card deck from which the initial five cards were dealt and that corresponds to the hand selected by the player. For example, if the player has selected HAND ONE to play, the replacement cards are dealt from Deck #1.

After the replacement cards are displayed to the player, the resulting five card is used to determine whether the player has a winning or losing hand based on poker hand rankings as shown in the payout table.

Just above the screen display is the payout table which shows the winning hand combinations and the amount of the payout to the player based on the number of coins, tokens or credits wagered by the player. In the preferred embodiment of the present invention, a conventional video poker payout table can be used as shown in Table 1.

| | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR ACES | 80 | 160 | 240 | 320 | 400 |
| FOUR 2's, 3's or 4's | 40 | 80 | 120 | 160 | 200 |
| FOUR 5's THRU KINGS | 20 | 40 | 60 | 80 | 100 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| THREE-OF-A-KIND | 2 | 4 | 6 | 8 | 10 |
| TWO PAIR | 1 | 2 | 3 | 4 | 5 |
| JACKS OR BETTER | 1 | 2 | 3 | 4 | 5 |

Alternatively, other payout tables can be utilized depending on the percentages the house wishes to retain.

With reference to FIG. 1, the player would most likely select HAND FOUR since this is the best poker hand showing a pair of Sevens.

The game can be applied to any variation of draw poker or stud poker, such as regular Draw Poker, Deuces Wild Poker, Bonus Poker, Double Bonus Poker, Double Double Bonus Poker, Triple Bonus and the like. Each of these video poker variations uses various arrangements of poker hand rankings as winning combinations. Wild cards can be added to the decks so that Joker's Wild or Deuce's Wild can be played. The game can be played in a live game version or an electronic video gaming machine can be programmed to display the game and provide the payouts to the player.

Other modifications of the present invention would include displaying three hands to the player and revealing either two or three cards face up prior to the time the player selects which of the three hands to play. Alternatively, two hands could be displayed to the player with either two or three cards being displayed face up prior to the time the player selects which of the two hands to play.

In accordance with the preferred embodiment of the present invention, when screen displays having four hands initially displayed to the player are used, no more than two cards of each hand should be displayed to the player prior to the player making his selection of which of the four hands he wishes to play. If more than two cards are displayed face up, the play of the game is affected since showing more than two cards face up creates a game that is more favorable to the player than to the house if conventional pay tables are used.

Likewise, for screen displays having two or three hands initially displayed to the player, no more than three cards of each hand should be displayed to the player prior to the player making his selection of which hand to play. In this embodiment, if more than three cards are shown face up, a game that is more favorable to the player than to the house is created if conventional pay tables are used.

Alternatively, the initial hands displayed to the player can be displayed as partial hands without showing the cards that are face down. In this embodiment of the present invention, only the face up cards are shown. For example, HAND ONE would be shown with only two face up cards, HAND TWO would be shown with only two face up cards, HAND THREE would be shown with only two face up cards and HAND FOUR would be shown with only two face up cards. The player would then select one of the partial hands as the hand the player wishes to play. The selected partial hand would then be completed by dealing the remaining three cards face up. The play of the hand would then continue in the manner described above with the player discarding unwanted cards and receiving replacement cards for the discarded cards.

In another alternative embodiment of the present invention in which all of the plurality of hands are dealt from a single deck, after the player selects one of the hands to play, the cards from the non-selected hands are returned to the deck and reshuffled into the deck in order to be available as replacement cards during the draw step. For example, with reference again to FIG. 1, if the player selects to play HAND ONE, all of the cards from HAND TWO, HAND THREE and HAND FOUR are returned to deck and are reshuffled into the deck so as to be available as replacement cards during the draw step. The method of play then continues as described above. The player selects which cards to hold (or to discard) and replacement cards are displayed from the reshuffled deck for the cards discarded.

The method of the present invention can also include special bonus payouts based on various card combinations occurring during the play of the game.

Figure 2:
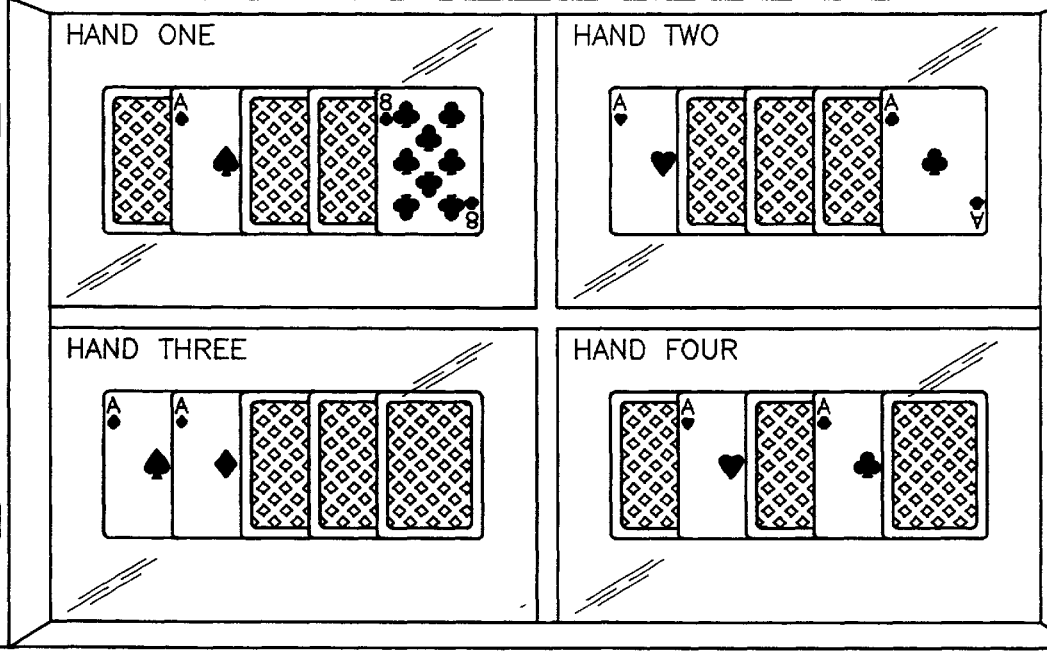
FIG. 2 shows a screen display and payout table used in the method of the present invention including an example of an initial deal which would pay the player for achieving a bonus payout.

In one preferred embodiment of the special bonus payouts, the initially displayed face up cards are used to determine the winning bonus combinations. With reference to FIG. 2, eight cards are shown face up when the initial four hands are dealt. The player can be awarded a special bonus payout if these eight cards are a pre-established winning combination. Any suitable winning combination of the initial eight cards can be used.

In the preferred embodiment of the present invention in which each hand is dealt from a separate deck of cards, a special bonus payout can be paid if some number (such as five, six, seven or even eight) of the initial eight face up cards are all of the same card rank (such as Aces, Kings, or the like) or if the player is dealt is two Four of a Kinds or other card combinations. For example, as shown in FIG. 2, the initial deal has eight face up cards among the four hands initially dealt. Seven of the eight face up cards are Aces, and the player can be awarded a special bonus payout for being dealt seven Aces on the initial deal. The amount of the special bonus payout is based on the mathematical probability of the winning combination occurring. Any suitable winning combination can be used for the special bonus payout.

In the preferred embodiment of the present invention in which a single common deck of cards is used to deal all of the plurality of hands, a special bonus payout can also be paid for certain pre-established winning combinations. An example of one such pre-established winning combination would be a five card Royal Flush occurring in the initial eight face up cards. Alternatively, the winning combination can be a six card Royal Flush (Ace through Nine of the same suit), a seven card Royal Flush (Ace through Eight of the same suit) or even an eight card Royal Flush (Ace through Seven of the same suit). Other suitable pre-established winning combinations that can be formed from a single deck of playing cards with or without one or more Jokers can be used.

The amount of the special bonus payout can be either a fixed jackpot amount or a progressive jackpot amount. When the amount of the special bonus payout is a fixed jackpot amount, it can be a multiple of the number of coins, tokens or credits wagered by the player to participate in the play of the game. For example, if the winning combination of the initial eight face up cards is a five card Royal Flush, the player can be paid a fixed jackpot amount of 25 coins for each coin wagered (with an increased payout of 400 coins for making the maximum wager of five coins to encourage the player to wager the maximum amount during the play of the game). Multiple winning combinations can be designated with all of the winning combinations being fixed payouts, all of the winning combinations being progressive payouts or a mixture of fixed and progressive payouts.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A method of playing a draw poker game comprising:

a) dealing a player a first five card hand from a deck of playing cards with two cards face up and three cards face down;

b) dealing the player a second five card hand from the same deck of playing cards with two cards face up and three cards face down;

c) dealing the player a third five card hand from the same deck of playing cards with two cards face up and three cards face down;

d) dealing the player a fourth five card hand from the same deck of playing cards with two cards face up and three cards face down;

e) the player selecting either the first hand, the second hand, the third hand or the fourth hand;

f) reshuffling into the deck of playing cards the cards from the non-selected hands;

g) the player either standing on the hand selected or discarding one or more cards from the hand selected;

h) dealing the player replacement cards for the discarded cards, if any;

i) determining a value for the player's selected hand based on poker hand ranking; and j) awarding the player a predetermined amount based on the value of the player's selected hand.

2. The method of claim 1 in which the deck of playing cards is a standard 52 card deck.

3. The method of claim 1 in which the deck of playing cards is a standard 52 card deck plus at least one extra Joker card which is treated as a wild card.

4. The method of claim 1 in which the deck of playing cards is a standard 52 card deck with at least one of the cards being treated as a wild card.

5. The method of claim 1 in which the value of the player's selected hand is determined by comparing the poker hand ranking of the player's selected hand to a payout schedule.

6. The method of claim 5 in which the predetermined amount based on the value of the player's selected hand is based on a payout schedule.

7. The method of claim 6 in which the payout schedule is as follows:

| | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR ACES | 80 | 160 | 240 | 320 | 400 |
| FOUR 2's, 3's or 4's | 40 | 80 | 120 | 160 | 200 |
| FOUR 5's THRU KINGS | 20 | 40 | 60 | 80 | 100 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| THREE-OF-A-KIND | 2 | 4 | 6 | 8 | 10 |
| TWO PAIR | 1 | 2 | 3 | 4 | 5 |
| JACKS OR BETTER | 1 | 2 | 3 | 4 | 5 |

8. The method of claim 1 further including a player wagering at least one coin to be eligible to participate in the game.

9. The method of claim 8 in which the predetermined amount that the player is paid is based on the number of coins wagered by the player.

10. The method of claim 1 in which the game is displayed on a video display screen on an electronic gaming machine.

11. A method of playing a draw poker game comprising:

a) dealing a player at least two partial hands, each partial hand being dealt from a common deck of playing cards and each partial hand being dealt with at least one card face up;

b) the player selecting only one of the partial hands;

c) reshuffling the cards from the unselected hands back into the common deck of playing cards;

d) dealing remaining cards to the selected partial hand to provide a five card hand, the remaining cards being dealt from the common deck of cards;

e) the player either standing on the selected five card hand or discarding one or more cards from the hand selected;

f) dealing the player replacement cards for the discarded cards, if any, the replacement cards being dealt from the common deck of playing cards;

g) determining a value for the player's selected hand based on poker hand ranking; and h) awarding the player a predetermined amount based on the value of the player's selected hand.

12. A method of playing a draw poker game comprising:

a) dealing a player a first five card hand from a common deck of playing cards with two cards face up and three cards face down;

b) dealing the player a second five card hand from the common deck of playing cards with two cards face up and three cards face down;

c) dealing the player a third five card hand from the common deck of playing cards with two cards face up and three cards face down;

d) dealing the player a fourth five card hand from the common deck of playing cards with two cards face up and three cards face down; and e) and awarding the player a predetermined amount if the eight face up cards form a pre-established arrangement of cards.

13. The method of claim 12 in which the pre-established arrangement of cards is an eight card Royal Flush.

14. The method of claim 12 in which the pre-established arrangement of cards is a seven card Royal Flush.

15. The method of claim 12 in which the pre-established arrangement of cards is a six card Royal Flush.

16. The method of claim 12 in which the pre-established arrangement of cards is a five card Royal Flush.

17. The method of claim 12 in which the pre-established arrangement of cards is Eight-of-a-Kind.

18. The method of claim 12 in which the amount awarded to the player is a fixed amount.

19. The method of claim 12 in which the amount awarded to the player is a progressive amount.

20. The method of claim 12 in which the game is displayed on a video display screen on an electronic gaming machine.

21. A method of playing a draw poker game comprising:

a) dealing a player a first five card hand from a first deck of playing cards with at least one card face down and the remaining cards face up;

b) dealing the player a second five card hand from a second deck of playing cards with at least one card face down and the remaining cards face up;

c) dealing the player a third five card hand from a third deck of playing cards with at least one card face down and the remaining cards face up;

d) dealing the player a fourth five card hand from a fourth deck of playing cards with at least one card face down and the remaining cards face up; and e) and awarding the player a predetermined amount if the face up cards form a pre-established arrangement of cards.

22. The method of claim 21 in which the pre-established arrangement of cards is Seven-of-a-Kind.

23. The method of claim 21 in which the pre-established arrangement of cards is Six-of-a-Kind.

24. The method of claim 21 in which the pre-established arrangement of cards is two Four-of-a-Kinds.

25. A method of playing a draw poker game comprising:

a) dealing a player at least two five card hands, each five card hand being dealt from a common deck of playing cards and each five card hand being dealt with at least one card face down and the remaining cards face up; and b) and awarding the player a predetermined amount if the face up cards form a pre-established arrangement of cards.

* * * * *